United States Patent [19]

Kramer

[11] 4,254,957

[45] Mar. 10, 1981

[54] GAME PIECE ARRANGEMENT GAME DEVICE

[76] Inventor: George A. Kramer, P.O. Box 39568, Los Angeles, Calif. 90039

[21] Appl. No.: 117,963

[22] Filed: Feb. 4, 1980

[51] Int. Cl.[3] ..... A63F 3/00

[52] U.S. Cl. ..... 273/271; 273/282; 273/288

[58] Field of Search ..... 273/271, 273, 282, 287, 273/288, 275

[56] References Cited

U.S. PATENT DOCUMENTS

| | | | |
|---|---|---|---|
| 1,221,493 | 4/1917 | Whitaker | 273/282 |
| 1,634,180 | 6/1927 | Felton | 273/288 X |
| 3,695,615 | 10/1972 | Shoptaugh | 273/282 X |
| 4,074,907 | 2/1978 | Curtis | 273/273 X |

FOREIGN PATENT DOCUMENTS

| | | | |
|---|---|---|---|
| 1114268 | 5/1968 | United Kingdom | 273/271 |

*Primary Examiner*—Anton O. Oechsle

[57] ABSTRACT

Set out herein is a game assembly comprising a board bounded by a peripheral edge strip and having deposited thereon diagonal rows of spaced rectangular raised projections for engaging V-shaped cut-outs in variously colored plane squares placed on the board. In this manner, a player selecting one color will continue, by turns to select the placement of his squares until a row or column or diagonal arrangement is achieved. The other player in interspaced turn may attempt to block the formation of the rows, columns or diagonals. The game may include a thirdly colored plane square which may be commonly used by both players.

4 Claims, 4 Drawing Figures

GAME PIECE ARRANGEMENT GAME DEVICE

BACKGROUND OF THE INVENTION

1. Field of the Invention

The present invention relates to entertainment devices and more particularly to devices wherein the players attempt to block each other in achieving geometric forms.

2. Description of the Prior Art

Games wherein geometric patterns are to be achieved have been known in the past. The most common example of such games is the tic-tac-toe game normally played. Such games, however, because of their simplicity, are often learned to a point where the player starting the game can predict the outcome by the original selection. Furthermore, most such games do not entail any scoring sequence, there being only a win or loss condition at the end thereof.

To facilitate the playing of such various geometric games the use of pen or pencil and scratch pad is most normally engaged in. This again renders the game less attractive since repeated engagement therein quickly accumulates in wasted paper. For these reasons there have been developed various games in the past where played parts are deposited on a surface which thus allow repeated use. Most often, however, such structural arrangements lack the visual indication of the desired game progression and furthermore lack the structural facility in the board for maintaining the played pieces fixed.

SUMMARY OF THE INVENTION

Accordingly, it is the general purpose and object of the present invention to provide a game assembly having a rectangular board conformed to include rows of spaced rectangular projections which are shaped to engage corresponding cut-outs in the played pieces.

Other objects of the invention are to provide a game assembly having as an object the arrangement of geometric parts in goemetric patterns.

Yet further objects of the invention are to provide a game assembly which is easy to produce, reliable in use and which may be played with less than a full complement of pieces.

Briefly these and other objects are accomplished within the present invention by providing a rectangular game board conformed to include diagonal rows of spaced rectangular projections, the spacing between the projections being arranged to fit V-shaped cut-outs in square plane pieces to be deposited thereon. These square plane pieces may be colored in various visually distinct color schemes, the object being that each player select a particular color. There may be additional colors provided which indicate that the plane piece is used as a "wild card". The diagonal arrangement of the spaced projection results in an X-shaped plan configuration in the square plane pieces. More specifically, the necessary V-shape cut outs in the pieces reduce the appearance theroef to an X aligned in the interspaces between the diagonal rows. The visual results achieved is quickly apparent. The diagonal legs of the "X" quickly point to a possible direction of further placement rendering the changes of winning by oversight less possible. In this manner the same structure that fixes the square played pieces on the surface of the board also assists in viewing the game progression. The pieces themselves may be simply produced by cut-off dyes resulting in an inexpensive, conveniently manufactured, and inexpensively priced marketable game.

DESCRIPTION OF THE SPECIFIC EMBODIMENT

Figure 1:
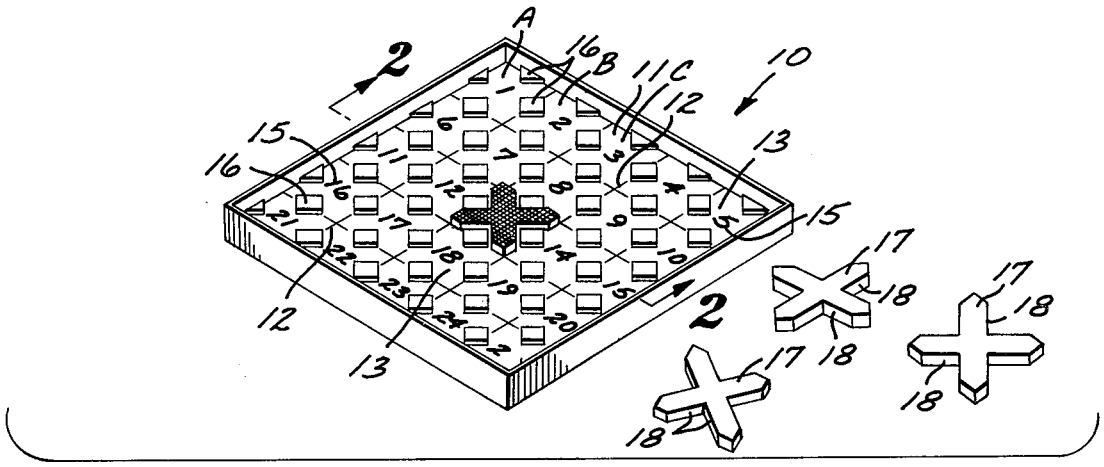
FIG. 1 is a perspective illustration of an assembly of parts constructed according to the invention herein.
Figure 2:
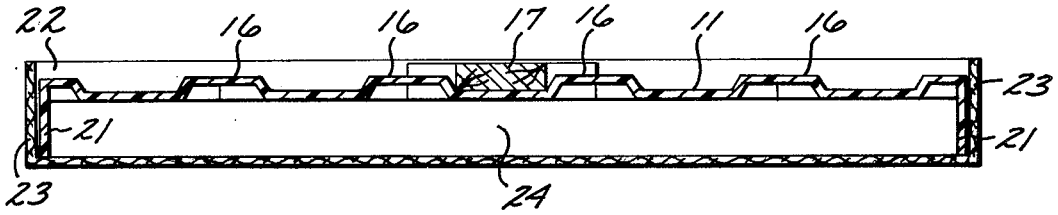
FIG. 2 is a sectional view taken along line 2—2 of FIG. 1.

As shown in FIGS. 1 and 2 the inventive game assembly generally designated by the numeral 10 comprises a rectangular game board 11 inscribed with lines 12 defining a plurality of equal squares 13 which because of their geometric form align in rows and columns on the board. Each square 13 may be inscribed with an appropriate scoring number 15 which may be used to score the play. Formed on the surface of the board 11 are a plurality of spaced, rectangular, projections 16 aligned in diagonal rows, each projection occupying a diagonal alignment on the common edges of the squares 13. Thus the available space of each square 13 is bounded by the projections 16 to essentially an X-shaped plan form conformed to receive matingly shaped planed pieces 17. Plane pieces 17 are generally square shaped planar elements each including four V-shaped cut-outs in the opposite edges thereof, such cut-outs being identified as cut-outs 18. By virtue of these V-shaped cut-outs the pieces 17 occupies the vacant space of squares 13 and may be variously colored as further denominated by the subscripts A, B and C.

The board 11 may be formed out of a plastic material structure and may include a peripheral edge bed 21 directed downwardly around the periphery thereof. A mating container 22 may be provided having a peripheral edge strip 23 within which the board 11 may be placed, strip 23 thus forming the outer edge. In this manner a cavity 24 is formed between the surface of board 11 and the horizontal surface of container 22, the cavity 24 being thus defined for storing the pieces 17 not in use.

Figure 3:
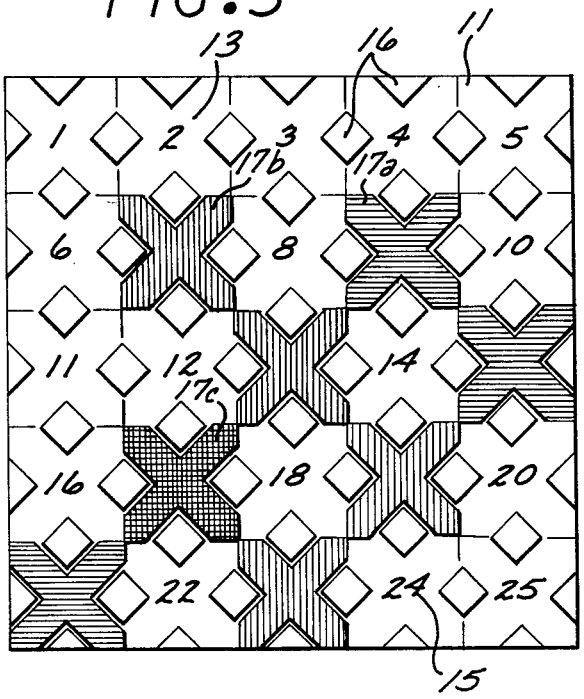
FIG. 3 is a plan view illustrating one exemplary arrangement of the game pieces arranged on a playing board according to the invention herein.

As shown in FIG. 3 the variously colored pieces 17*a*–17*c* may be placed on the board by the opposing players in succession, each player being assigned a particular color. The players then proceed, in turns, to arrange their pieces 17 in either rows, columns, or diagonal lines, of predetermined piece dimension. The number of pieces in each line may then be used to determine a score or the actual numbers 15 inscribed on the boards may be utilized for scoring. The game may be further enhanced by coloring only one side of the plane pieces 17 and by placing the pieces with the uncolored side up, an element of chance is introduced as to what colored piece the player picks up.

Figure 4:
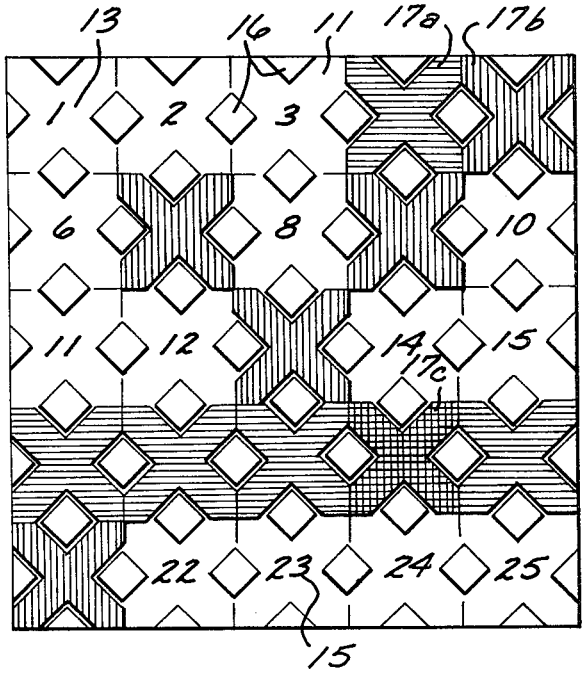
FIG. 4 is yet another plan view illustrating a further example of the arrangement of played pieces on a playing board.

As shown in FIGS. 3 and 4, various arrangements can be thus achieved. For example, a third color may be assigned as a wild card and the players may jointly use that piece. Thus various levels of gaming may be achieved in a simple structure, expanding the entertainment value thereof and continued enjoyment.

Obviously, many modifications and changes can be made to the foregoing description without departing from the spirit of the invention. It is therefore intended that the scope of the invention be determined solely on the claims appended hereto.

What is claimed is:

1. A game assembly adapted to selectively retain in geometric arrangement playing pieces comprising:

a rectangular planar board including a peripheral edge disposed thereabout, said edge extending normally about the plane of said board to form a containing structure in conjunction therewith, said board further including a plurality of diagonally aligned raised square projections on the surface thereof in equal spacing increments for defining equal playing fields there between; and said playing pieces are each conformed as rectangular plates of a size substantially equal to that of said fields, each said piece including V-shaped cutouts at each edge thereof adapted to receive said diagonally aligned projections.

2. Apparatus according to claim 1 wherein: said pieces include face surfaces coated with preselected colors.

3. Apparatus according to claim 2 wherein: said pieces and said board are made of a plastic material structure.

4. Apparatus according to claim 3 further comprising: a base enclosure of a concave shape conformed to receive said board on the interior for defining a closed cavity therewith.

* * * * *